United States Patent [19]

Durham

[11] 4,368,819

[45] Jan. 18, 1983

[54] INSULATED CONTAINER AND CLOSURE

[76] Inventor: Harvey Durham, P.O. Box 164, Manila, Ark. 72442

[21] Appl. No.: 244,195

[22] Filed: Mar. 16, 1981

[51] Int. Cl.[3] ..... B65D 43/06; B65D 90/04; B65D 90/06

[52] U.S. Cl. ..... 206/545; 206/828; 206/544; 220/355; 220/902; 220/412

[58] Field of Search ..... 206/541, 542, 545, 546; 215/13 R, 317; 217/128, 131; 220/412, 413, 415, 352, 354, 355, 411, 902; 62/371, 372, 457, 529, 530

[56] References Cited

U.S. PATENT DOCUMENTS

| | | | |
|---|---|---|---|
| 795,126 | 7/1905 | Hodgson | 220/354 |
| 2,740,516 | 4/1956 | Renn . | |
| 2,766,796 | 10/1956 | Tupper | 150/0.5 |
| 2,977,014 | 3/1961 | Kock | 215/12 |
| 3,052,371 | 9/1962 | Van Bemmelen | 220/354 |
| 3,148,515 | 9/1964 | Jentis et al. | 62/222 |
| 3,472,568 | 10/1969 | Southwick | 312/31 |
| 3,605,435 | 9/1971 | Taylor | 220/902 |
| 3,741,382 | 6/1973 | Larimer . | |
| 3,807,194 | 4/1974 | Bond | 62/457 |
| 4,098,421 | 7/1978 | Foster | 215/321 |
| 4,250,998 | 2/1981 | Taylor | 62/371 |

FOREIGN PATENT DOCUMENTS

| | | | |
|---|---|---|---|
| 1030157 | 5/1958 | Fed. Rep. of Germany | 220/352 |
| 2875 | 7/1980 | Inter'l Pat. Institut | 220/410 |

*Primary Examiner*—William Price
*Assistant Examiner*—Brenda J. Ehrhardt
*Attorney, Agent, or Firm*—Dowell & Dowell

[57] ABSTRACT

An insulated container and closure comprising a closure portion having spaced double walls filled with insulating foam and having an upwardly extending tongue around its upper periphery, the tongue having upwardly converging surfaces, and a closure portion having an insulated lid panel with a downwardly bifurcated flange extending around the lid panel and defining two legs with a groove therebetween to receive the tongue, the inner surfaces of the legs diverging downwardly at lesser angles to the vertical than the outer surfaces of the tongue to provide a frictional sealing grip on the tongue, the container having a compartmented liner to receive a bottle and having roughened outer surfaces to reduce heat transfer between the container and other adjacent bodies.

6 Claims, 4 Drawing Figures

INSULATED CONTAINER AND CLOSURE

BACKGROUND AND PRIOR ART

There is a need for an insulated container which can be quickly and easily opened and closed and which can be carried in the pocket or in a purse to carry medicines or other perishables which require cooling, such as insulin for the diabetic. It is well-known that insulin must be kept at a temperature below normal room and body temperatures during the time that it is stored, and this raises a considerable problem for diabetic persons who travel. To carry an unprotected insulin bottle on the person is to expose it to much higher storage temperatures than can be tolerated. It is therefore necessary to provide an insulated container and closure in which such insulin can be safely carried without raising its temperature above permissable levels.

This problem has been recognized in Jentis et al U.S. Pat. No. 3,148,515 which shows a travelling kit for diabetics having an insulin storage compartment which can be cooled by the slow escape of a compressed gas to produce a refrigeration effect, the kit being, however, too large and cumbersome to be easily carried in anything smaller than a suitcase. Another diabetic's emergency kit is shown in Renn U.S. Pat. No. 2,740,516, which also stores other apparatus but is unrefrigerated and uninsulated.

U.S. Pat. No. 3,807,194 to Bond shows a thermal container whose structure is more similar to the wall construction of the present invention in that it includes inner and outer spaced rigid walls which are filled with an insulating foam, the lid being screwed onto the container in this showing.

U.S. Pat. No. 3,741,382 to Larimer shows a bottle packed in an insulating container which is apparently more concerned with shock than heat transfer, and shows a container fitted to receive a particular bottle. Southwick U.S. Pat. No. 3,472,568 also is fitted to receive and support a particular shape of bottle. U.S. Pat. No. 2,977,014 to Kock shows an insulated container supporting an ampoule.

There are of course many plastic containers in which the lid is shaped to seal on some sort of tongue, of which U.S. Pat. No. 2,766,796 to Tupper is an example.

THE INVENTION

The invention comprises separable insulated plastic container and closure portions, the container portion having thick bottom and sidewalls which actually comprise inner and outer nested and spaced plastic shells containing heat insulating material therebetween. The two shells join each other near the top periphery of the sidewalls and terminate in an upwardly tapering tongue which extends all the way around the mouth of the container and is of truncated triangular cross section. The closure portion comprises a lid panel which is lined with insulating material and which has a downwardly bifurcated flange extending all the way around the lid. In cross section, the flange comprises two downwardly extending legs defining a tongue-receiving groove, the legs having opposed inside surfaces which diverge downwardly at an angle therebetween which is less than the angle between said upwardly converging side surfaces of the tongue. The tongue around the shell portion of the container and the lid-panel legs are made of plastic materials which provide a good mutual coefficient of friction, whereby when the closure portion is applied to the container portion, the legs of the flange are spread somewhat, the angle of the tongue portion being selected so as to provide adequate forces to frictionally retain the closure on the container without requiring hinges or latches.

OBJECTS AND ADVANTAGES

It is a major object of this invention to provide an improved container and closure having good insulating properties and having an excellent seal between the closure and container portions so as to form a watertight union which will remain watertight even though the container is carried in a pocket or purse and subjected to various different angles of rest. It is particularly important to provide watertight sealing so that loose ice cubes can be safely carried in the container next to an insulin bottle to keep the bottle cold, the sealing of the closure to the container portion preventing leakage of ice water, and the insulation slowing the melting of the ices so that cooling is preserved for a very long time.

It is another major object of the invention to provide a small insulin carrying container which, when closed, is substantially regular shape and has an outside contour essentially free of protruding hinges or latches, so that there will be nothing outside of the container tending to snag on the contents of the pocket or purse in which it is carried.

Still another important object of the invention is to provide a plastic container which is friction sealed, and which provides liquid tight sealing because of the large contact area between the tongue and groove surfaces at the seal, thereby discouraging the escape of melting ice water therefrom. The plastics of which the tongue and groove portions are made are of types which are not wetted by water, whereby the frictional engagement is not lost if water gets on these portions during use and prior to resealing.

Yet another object of the invention is to provide a friction seal wherein a tongue and groove structure is used, the groove of the seal being formed between two plastic legs which can flex apart somewhat when the tongue is entered between them so as to provide a wedging action through a lengthy engagement. The angle through which the legs are spread, and the angles at which the tongue and groove surfaces meet, are carefully selected so as not to overstress the plastic but so as to provide sufficient frictional drag to keep the closure firmly in place on the container.

Yet another object of the invention is to provide a container for carrying in the pocket of a user wherein the container is provided with a roughened outer surface so as to minimize the contact area between the outer wall of the container and adjacent bodies such as the side of the user, thereby slowing heat transfer from the person into the container by conduction.

A further object of the invention is to provide a compartmented container having a cylindrical opening for containing an insulin bottle, one sidewall of the opening being partly cut away so as to communicate into an adjacent coolant compartment in which ice cubes are carried for cooling the insulin bottle.

Other objects and advantages of the invention will become apparent during the following discussion of the drawings:

THE DRAWINGS

Figure 3:
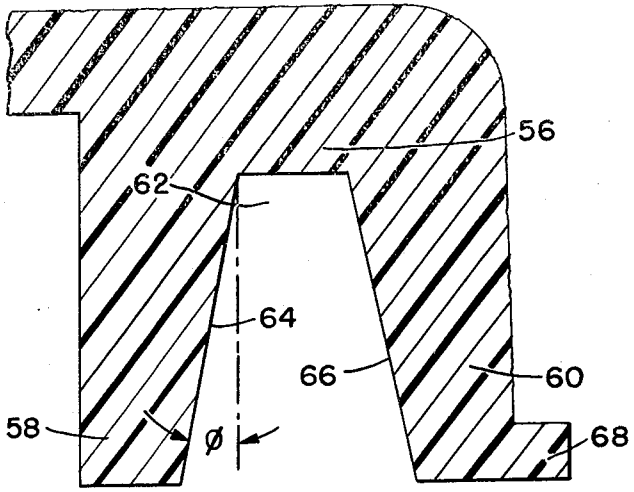
Figure 4:
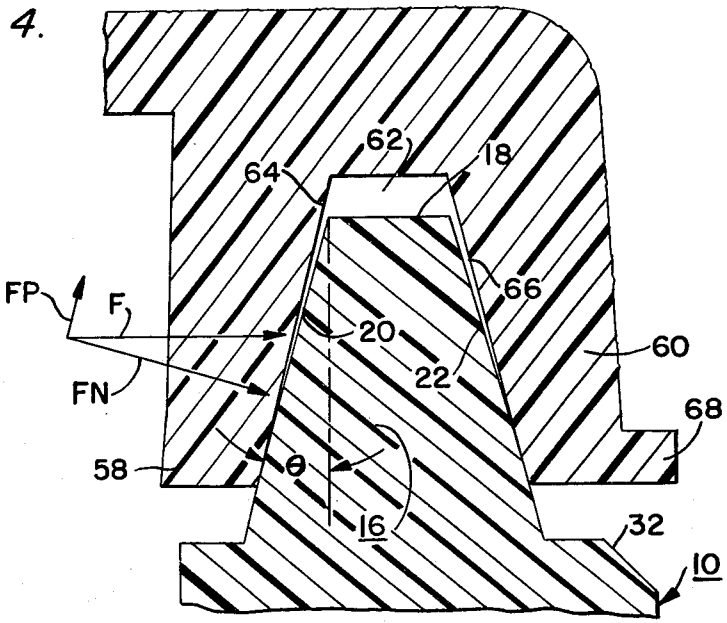

FIG. 3 is a partial enlarged cross sectional view of the grooved flange at one edge of the closure portion; and FIG. 4 is a partial cross sectional view similar to FIG. 3 of the flange at the edge of the closure portion, and showing it mating with the tongue extending upwardly from the periphery of the container portion, the legs of the flange being distorted outwardly as the closure portion is pressed onto the container portion.

Figure 1:
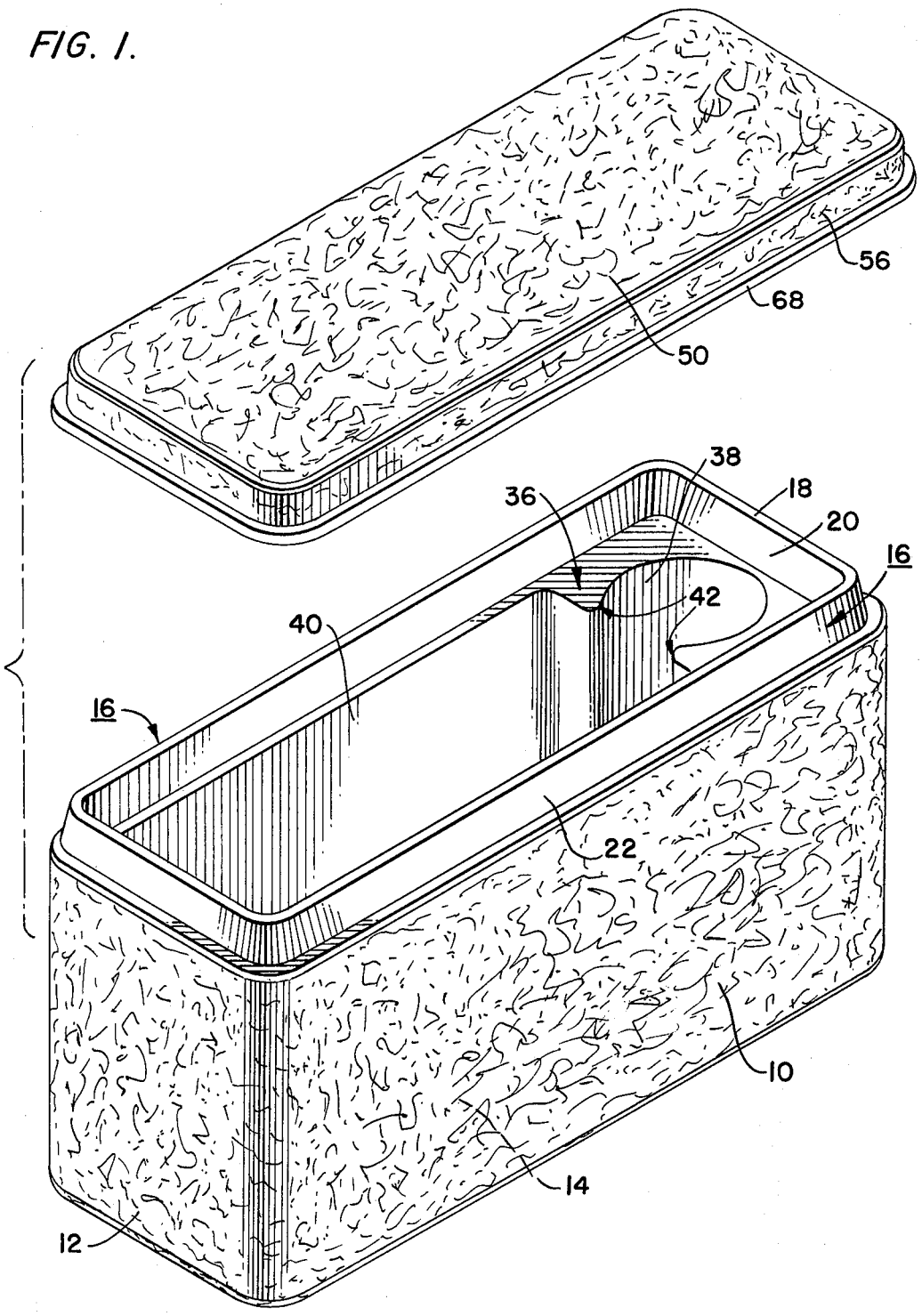
FIG. 1 is a perspective view of an insulated container and closure, with the closure removed from the container.

Referring now to the drawings, FIG. 1 shows a perspective view of a container and closure, the container having sidewalls such as the wall 10 and the wall 12, having a bottom wall 14, and having an upwardly extending tongue 16 all the way around the upper periphery of the sidewalls 10 and 12. The tongue is of truncated cross sectional shape as can best be seen in FIG. 4, the tongue having an upper surface 18, and having two upwardly converging side surfaces 20 and 22. Each of the side surfaces 20 and 22 as shown in FIG. 4 lies at an angle to the verticle, $\theta$, although it is not necessary that one of the side surfaces be inclined at the same angle as the other side surface.

Figure 2:
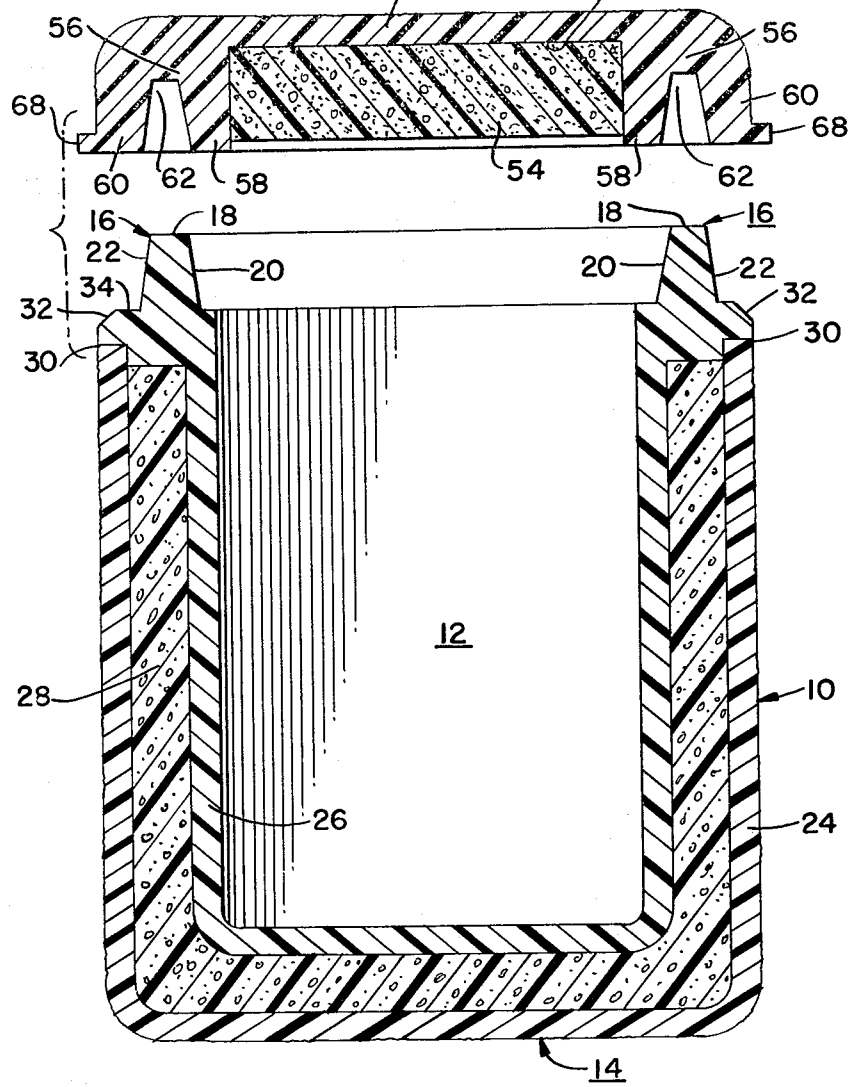
FIG. 2 is a cross sectional view taken transversely through the container and lid in a vertical plane and showing the lid removed from the container.

As can be seen best in FIG. 2, the lower container portion 10 actually comprises external and internal shells. Both the outer shell 24 and the inner shell 26 are made of polypropylene in the preferred embodiment, the space between the two shells being filled with plastic insulating foam 28 before the outer shell 24 is sealed to the inner shell at their junction in the vicinity of the reference character 30. Outside of the tongue 16 and near the top of the shell 26, the outer edge is beveled as at 32 so that the upper peripheral surface 34 of the container portion is relieved around its outer edge to make it easier to insert a finger so as to remove the closure portion as will be discussed hereinafter with reference to FIG. 4.

Within the container portion as shown in FIG. 1, compartmentation is desirable if the container is intended to hold a specific shape object, such as an insulin bottle. Since the illustrative embodiment in this disclosure is directed toward this purpose, an appropriate liner 36 is shown only in FIG. 1, this liner being made of styrofoam. The liner 36 has a cylindrical opening 38 to receive an insulin bottle, and has a rectangular compartment 40 to receive a refrigerant, such as ice cubes or a frozen brine package made for this type of use. Between the compartments 38 and 40 a slot defined by the edges 42 is provided to permit rapid heat transfer between compartments. The bottle compartment 38 extends around more than 180° in arc so that the insulin bottle cannot escape through the slot 42. Obviously the configuration of the liner 36 can be varied to suit the intended use to which the container is to be put.

The closure portion is shown at the tops of FIGS. 1 and 2, and comprises a lid panel 50 having an internal recess 52 which is filled with insulating foam 54. The panel has a downwardly bifurcated flange 56 extending all the way around it, and the flange divided into inner and outer downwardly extending legs 58 and 60 defining a tongue receiving groove 62 between them. As can be seen best in FIG. 3, the legs 58 and 60 have downwardly diverging opposed inside surfaces 64 and 66 which in the preferred embodiment of the invention respectively make an angle $\phi$ with the vertical when the legs are in relaxed positions as shown in FIG. 3, the legs being spread somewhat when the closure portion is mated to the container portion as is the case illustrated in FIG. 4, although the parts are less than fully mated in that view. The angle $\phi$ must be less than the angle $\theta$ in order for the lid to remain in closed position as will be discussed hereinafter.

The outer leg 60 has an outwardly extending lip 68 around it, this lip being located opposite the chamfer 32 as can be seen in the lower righthand corner of FIG. 4, thereby making it easy to insert a finger upwardly past the chamfer to press the lid open by pressing against the lip 68. Such upward motion also tends to spread the leg 60 outwardly and away from the surface 22 of the tongue, thereby relieving the friction between the mating surfaces 22 and 66 to still further facilitate opening of the container.

Referring to FIGS. 3 and 4, in the illustration embodiment the closure portion and the legs 60 and 58 are made of polyethylene plastic, whereas the tongue 16 is made of polypropylene plastic, and these two plastics have non-wetting surface characteristics and a definite coefficient of friction between them. For the sake of giving a working example, it is assumed that the mutual coefficient of friction u is equal to about 0.15. For the angle $\theta$ a satisfactory angle has been found to be about 8°. In the relaxed condition of the legs 58 and 60, the angle $\phi$ should be less than 8°, for instance about 6°. The greater the difference between $\theta$ and $\phi$, the more force F is applied by each of the legs in the direction of the arrow shown in FIG. 4. This force is attributable to distortion of the legs when the closure is pressed tightly down upon the container flange 16 so that the groove 62 is filled by the tongue 16 as has partially occurred in FIG. 4.

This force F can be divided into two compartments, the Component FN which represents the force applied normal to the surfaces 20 and 22, and the component FP which is applied perpendicular to the force FN and parallel to the respective side surfaces 20 and 22. In order for the lid to remain tightly in place, it is necessary that the friction between the side surfaces 20 and 64, and between the side surfaces 22 and 66, be greater than the sum of the forces FP tending to wedge the lid back off of the tongue 16. Of course, the frictional drag should be considerably greater than the sum of the forces FP so as to insure that the closure will not accidentally part from the container during storage and transportation. The following calculations show what is necessary to the proper retention of the lid on the container. Assuming that the coefficient of friction u equals 0.15, and assuming $\theta$ to be 8°, the frictional drag D tending to keep the closure on the container will be equal to the force F multiplied by u Cos $\theta$, which will be $0.15 \times F \times 0.9902 = 0.1485$ F.

On the other hand, the force FP tending to cause the lid to slide off of the tongue 16 is equal to F Sin $\theta = F \times 0.1391$.

The lid will remain in place as long as the frictional drag D is greater than FP. For the above mentioned numerical parameters, $D = 0.1485$ F which is clearly greater than FP which equals 0.1391 F. Actually, these forces are doubled because such forces occur both between the inside surfaces 20 and 64 and the outside surfaces 22 and 66, FIG. 4. Of course greater restraining forces can be achieved by decreasing the angle $\phi$ so as to increase the force F pressing the legs against the tongue 16.

The present invention is not to be limited to the particular structure shown in the drawings, or to the particular materials and angles which are used to illustrate the present invention in terms of a practical embodiment, since changes may be made within the scope of the following claims.

I claim:

1. An insulated container and closure, comprising:

(a) a container portion comprising bottom and side walls having insulating material sealed therein, the upper periphery of the container side walls supporting an upwardly extending tongue therearound having a triangular cross section with upwardly converging side surfaces;

(b) a closure portion comprising a lid panel having insulating material therein, and having a downwardly bifurcated flange therearound, the flange in cross section comprising two downwardly extending legs defining therebetween a tongue-receiving groove, the legs having opposed inside surfaces diverging downwardly at an angle therebetween less than the angle between said upwardly converging side surfaces of the tongue; and (c) the tongue being made of polypropylene plastic material and the angle of each of its side surfaces with respect to vertical being about 8 degrees, and the flange being made of polyethylene plastic material and the angle of each of its inside surfaces with respect to vertical being about 6 degrees, the difference in angle between the inside surfaces of the groove and the side surfaces of the tongue, and the plastic materials of which the surfaces are made, being selected to provide compression of said inside surfaces against said side surfaces with a coefficient of friction therebetween sufficient to retain the flange on the tongue.

2. The container and closure as claimed in claim 1 wherein the container houses a liner shaped to provide a bottle-retaining compartment and a coolant-containing compartment, and the liner having a slot communicating between the compartments for transferring heat therebetween.

3. The container and closure as claimed in claim 1, wherein the container portion comprises inner and outer nesting shells with a space between their respective bottom and side walls, and the space being filled with insulating material, the shells being joined together near the upper edges of their side walls and supporting the tongue thereadjacent.

4. The container and closure as claimed in claim 1, wherein said converging surfaces of the tongue extend from the periphery of the side walls by a distance greater than the transverse thickness of the tongue to provide a large sealing area.

5. The container and closure as claimed in claim 4, wherein the tongue has a truncated triangular cross section, the groove in the flange of the closure being shaped to fully receive the tongue.

6. The container and closure as claimed in claim 1, wherein said periphery of the side walls is externally chamfered, and wherein the flange has a lip extending outwardly over the chamfered periphery of the side walls.

* * * * *